US011365747B2

(12) United States Patent
Chan et al.

(10) Patent No.: US 11,365,747 B2
(45) Date of Patent: Jun. 21, 2022

(54) FAN

(71) Applicant: DELTA ELECTRONICS, INC., Taoyuan (TW)

(72) Inventors: Chih-Wei Chan, Taoyuan (TW); Ching-Hsien Yeh, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 200 days.

(21) Appl. No.: 15/941,776

(22) Filed: Mar. 30, 2018

(65) Prior Publication Data

US 2019/0128278 A1 May 2, 2019

(30) Foreign Application Priority Data

Oct. 26, 2017 (CN) ..... 201711014284.X

(51) Int. Cl.

| | |
|---|---|
| ***F04D 29/28*** | (2006.01) |
| ***F04D 29/66*** | (2006.01) |
| ***F04D 29/30*** | (2006.01) |
| ***F04D 25/06*** | (2006.01) |

(52) U.S. Cl.

CPC ..... *F04D 29/281* (2013.01); *F04D 25/0613* (2013.01); *F04D 29/30* (2013.01); *F04D 29/663* (2013.01); *F04D 29/666* (2013.01); *F05D 2240/303* (2013.01)

(58) Field of Classification Search

CPC ..... F04D 29/281; F04D 29/30; F04D 29/663; F04D 29/666; F04D 25/0613; F05D 2240/303

See application file for complete search history.

(56) References Cited

U.S. PATENT DOCUMENTS 867,874 A 10/1907 Capell
3,205,828 A * 9/1965 Rupp ..... F04D 29/2205 415/199.1
3,536,417 A * 10/1970 Hans ..... F04D 29/324 416/223 R (Continued)

FOREIGN PATENT DOCUMENTS

CN 202833298 U 3/2013
CN 203879797 U 10/2014

(Continued)

*Primary Examiner* — Kenneth Bomberg
*Assistant Examiner* — Adam W Brown
(74) *Attorney, Agent, or Firm* — Kirton McConkie; Evan R. Witt

(57) ABSTRACT

A fan includes a hub and a blade assembly. The hub has a central portion and an extension portion. The extension portion is extended outwardly from a peripheral edge of the central portion. The blade assembly includes a plurality of blades. Each blade has a leading edge, each of the leading edges is an end point of each blade that is most close to the central portion. The blades are disposed around the hub. At least a part of the leading edges of the blades are connected to the extension portion, and distances between a center of the central portion and the leading edges of at least two blades are different. Therefore, the factors of fan and the quality of voice could be enhanced, and the multi-frequencies noise could be avoided during operation.

24 Claims, 9 Drawing Sheets

(56) References Cited

U.S. PATENT DOCUMENTS

| | | | | |
|---|---|---|---|---|
| 5,026,251 | A * | 6/1991 | Kinoshita | B60H 1/00471 415/119 |
| 8,313,300 | B2 * | 11/2012 | Gerhardt | F04D 29/284 416/186 R |
| 9,765,788 | B2 * | 9/2017 | Dybenko | F04D 25/0613 |
| 9,920,768 | B2 * | 3/2018 | Bruss | F04D 29/281 |
| 10,167,766 | B2 * | 1/2019 | Birschbach | F04D 17/16 |
| 10,422,350 | B2 * | 9/2019 | Herrou | F04D 29/663 |
| 2002/0051707 | A1 * | 5/2002 | Takahashi | B29C 45/0062 416/186 R |
| 2015/0152883 | A1 * | 6/2015 | Dybenko | F04D 25/0613 415/220 |
| 2016/0281730 | A1 * | 9/2016 | Bruss | F04D 29/281 |
| 2017/0002836 | A1 * | 1/2017 | Herrou | F04D 29/663 |

FOREIGN PATENT DOCUMENTS

| | | | |
|---|---|---|---|
| CN | 104314865 | A | 1/2015 |
| CN | 204900330 | U | 12/2015 |
| DE | 174855 | A | 8/1905 |
| JP | H10299694 | A | 11/1998 |

* cited by examiner

FAN

CROSS-REFERENCE TO RELATED APPLICATION

This application claims priority from China Patent Application No. 201711014284.X, filed on Oct. 26, 2017, the entire contents of which are incorporated herein by reference for all purposes.

TECHNICAL FIELD

The present disclosure relates to a fan, and more particularly to a fan effectively avoiding the multi-frequencies noise during operation.

BACKGROUND

The demands of heat-dissipation in industry are increased. However, the space of the system is not increased accordingly. Instead, the trend of development is to reduce the space of wind entrance area. Therefore, generally the design of blades of fans is turned to the direction of high static pressure and high capacity. The developments include the change of the amount of blades, the blades with variable curvatures and slim blades. However, when providing high-performance fans, the multi-frequencies of blades caused by the cooperation of the fan and the system are increased and unable to be avoided. The noises exceeded the range of the application of the system usually exceeds the noise range that people can feel, thereby becoming a large amount of sensible noises.

Please refer to FIGS. 1A, 1B and 1C, which respectively illustrates the frequency-volume diagrams of three different fans. It is obvious that the volume peaks are distributed in the frequency range between 2000-5000 Hz as shown in FIG. 1A. It is obvious that there are several main volume peaks distributed in the frequency range between 1000-5000 Hz as shown in FIG. 1B. In addition, it can be known that the volume peaks are distributed in the frequency range between 500-5000 Hz as shown in FIG. 1C. The peaks are mainly caused by the regular design of the blade structure of the conventional fan, in which the multi-frequencies are easily generated while operation due to the similar characteristics.

Some developments in the prior art include the change of size of wind entrance, the change of distance between tongues of fan and the adjustment of rotational center of blade corresponding to the relative position of flow path. However, those developments decrease the efficiency of the fan, hence the fan characteristic and sound quality cannot be kept.

Therefore, there is a need of providing an improved fan distinct from the prior art in order to solve the above drawbacks.

SUMMARY

Some embodiments of the present disclosure are to provide a fan in order to overcome at least one of the above-mentioned drawbacks encountered by the prior arts.

The present disclosure provides a fan. By the features that the distances between the leading edges of the blades and the center of the central portion are different, the energies of the blades can be dispersed as an irregular spectrum, thereby avoiding the multi-frequencies noise during operation. Furthermore, the lengths of the adjacent blades are designed to be different, the sound spectrum can further be dispersed. Not only the work area of the blades can be retained, but also the same heat radiation property can be provided and the advantages of nice sound quality can be achieved.

In accordance with an aspect of the present disclosure, there is provided a fan. The fan includes a hub and a blade assembly. The hub has a central portion and an extension portion. The extension portion is extended outwardly from a peripheral edge of the central portion. The blade assembly includes a plurality of blades. Each blade has a leading edge, each of the leading edges is an end point of each blade that is most close to the central portion. The blades are disposed around the hub. At least a part of the leading edges of the blades are connected to the extension portion, and distances between a center of the central portion and the leading edges of at least two blades are different.

In accordance with another aspect of the present disclosure, there is provided a fan. The fan includes a hub, a first blade assembly and a second blade assembly. The hub has a central portion and an extension portion. The extension portion is extended outwardly from a peripheral edge of the central portion. The first blade assembly includes a plurality of first blades. Each first blade has a first leading edge. Each of the first leading edges is an end point of each first blade that is most close to the central portion. The first blades are disposed around the hub. At least a part of the first leading edges of the first blades are connected to the extension portion. Distances between a center of the central portion and the first leading edges of at least two first blades are different. The second blade assembly includes a plurality of second blades. Each second blade has a second leading edge. Each of the second leading edges is an end point of each second blade that is most close to the central portion. The second blades are disposed around the hub. At least a part of the second leading edges of the second blades are connected to the extension portion. Distances between a center of the central portion and the second leading edges of at least two second blades are different.

In accordance with another aspect of the present disclosure, there is provided a fan. The fan includes a hub and a blade assembly. The hub has a central portion and an extension portion. The extension portion is extended outwardly from a peripheral edge of the central portion. The blade assembly includes a plurality of blades. The blades are disposed around the hub. Each blade has a front end. Each of the front ends is a part of each blade close to the central portion. The front ends of at least two blades are connected to the extension portion. Lengths of connected parts of the front ends connected to the extension portion are different.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
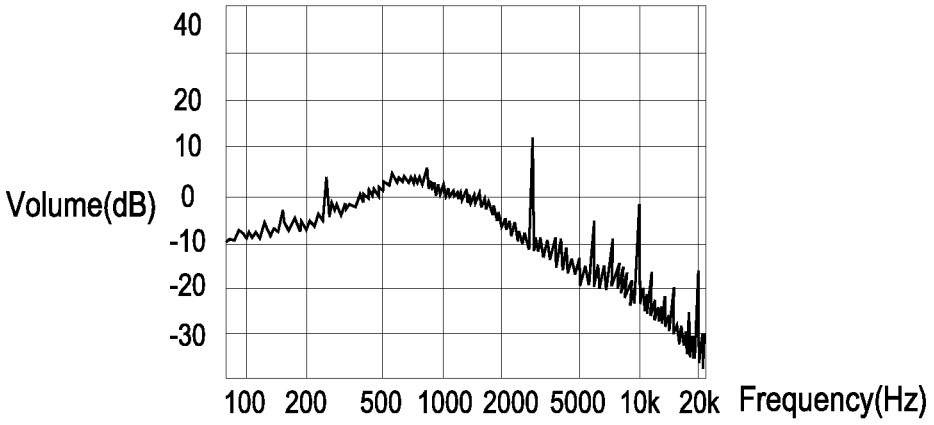
FIG. 1A PRIOR ART
FIGS. 1A, 1B and 1C schematically illustrate the frequency-volume diagrams of three different fans.
Figure 1B:
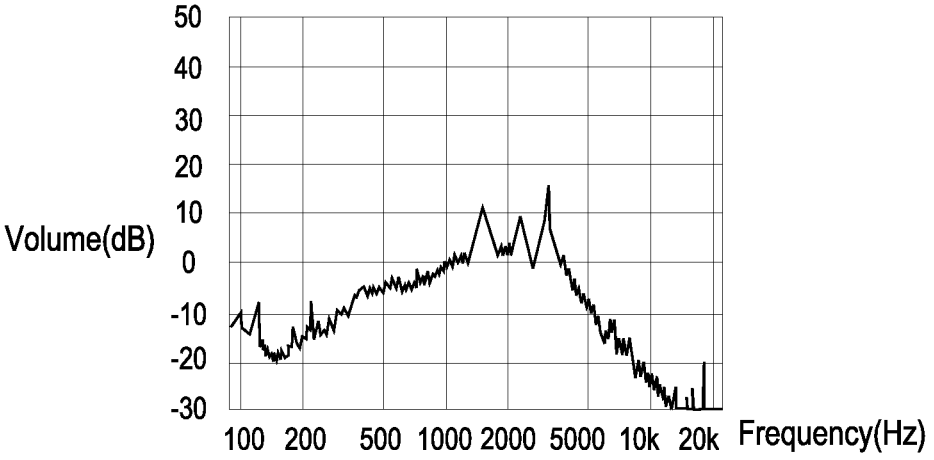
FIG. 1B PRIOR ART
Figure 1C:
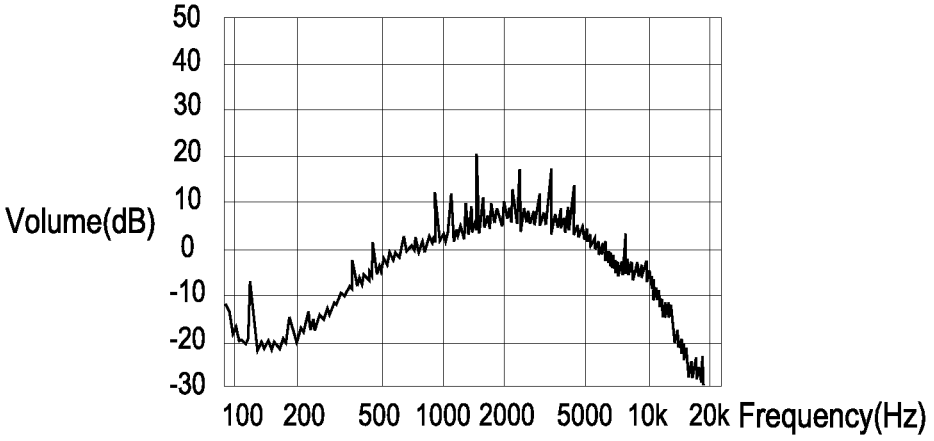
FIG. 1C PRIOR ART
Figure 2A:
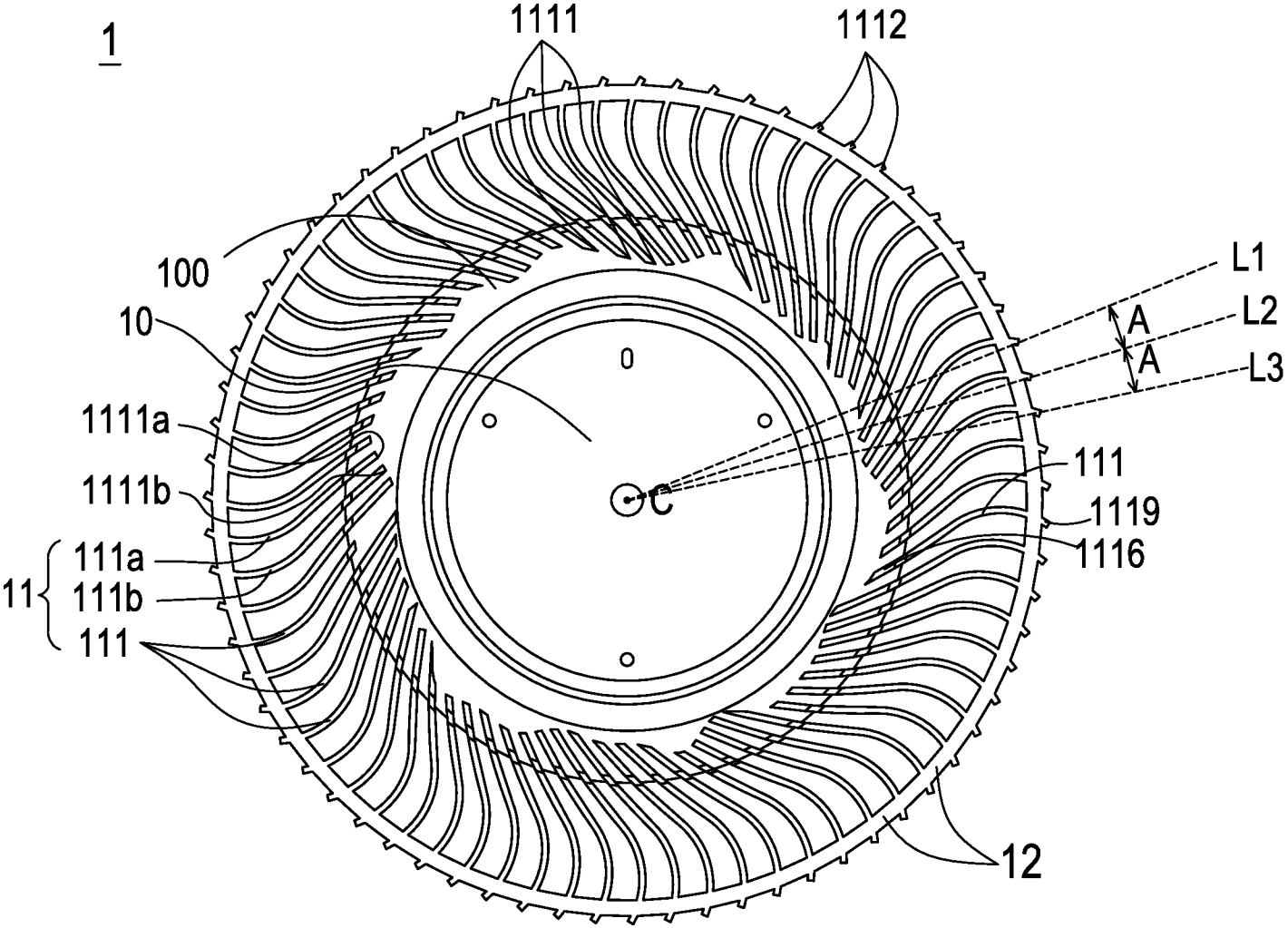
FIG. 2A schematically illustrates the front view of a fan according to an embodiment of the present disclosure.
Figure 2B:
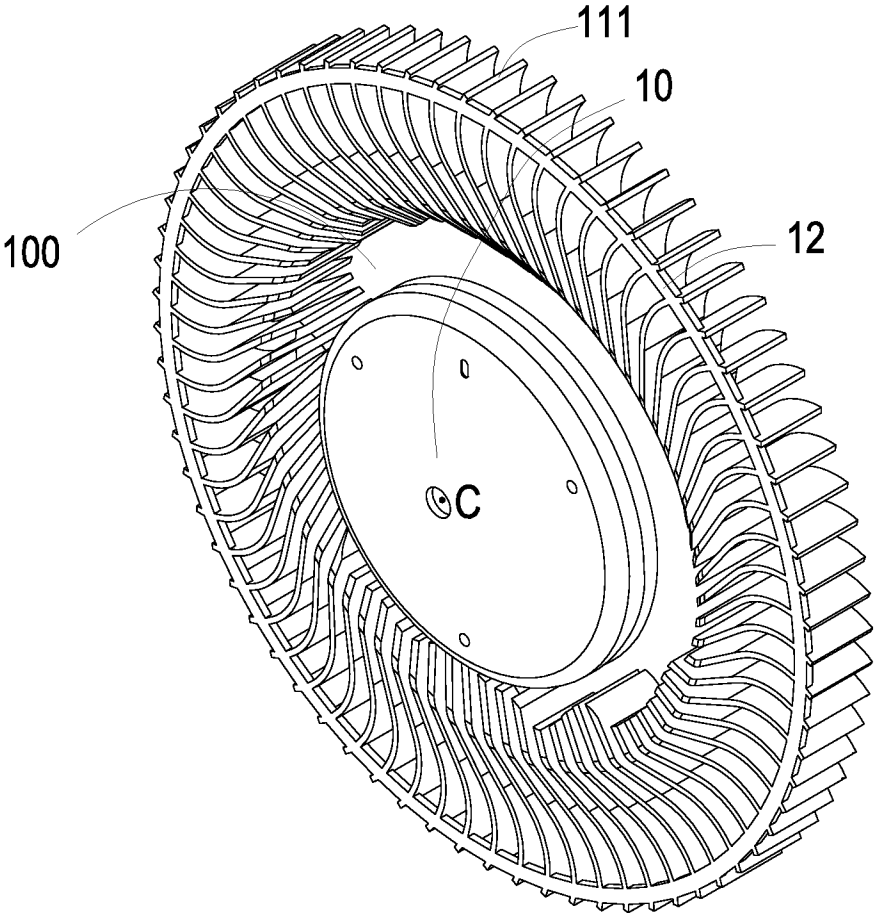
FIG. 2B schematically illustrates the structural view of a fan according to an embodiment of the present disclosure.

Please refer to FIGS. 2A and 2B. FIG. 2A schematically illustrates the front view of a fan according to an embodiment of the present disclosure. FIG. 2B schematically illustrates the structural view of a fan according to an embodiment of the present disclosure. As shown in FIGS. 2A and 2B, a fan 1 according to an embodiment of the present disclosure includes a hub 10 and a blade assembly 11. The hub 10 has a central portion C and an extension portion 100. The extension portion 100 is extended outwardly from a peripheral edge of the central portion C. The blade assembly 11 includes a plurality of blades 111. Each blade 111 has a leading edge 1111. Each of the leading edges 1111 is an end point of each blade 111 that is most close to the central portion C. The blades 111 are disposed around the hub 10. At least a part of the leading edges 1111 of the blades 111 are connected to the extension portion 100. Distances from at least two leading edges 1111 to the center of the central portion are different, that is, the distance from one leading edge 1111 to the center of the central portion C is different from that from another leading edge 1111 to the center of the central portion C.

In some embodiments, each blade 111 has a rear tip 1119. Each of the rear tips 1119 is an end point of each blade 111 that is far away from the central portion C. In addition, the fan 1 further includes a ring-shaped structure 12. The ring-shaped structure 12 is disposed around the hub 10 with center at the center of the central portion C. The ring-shaped structure 12 is connected to the adjacency of the rear tip 1119 of each blade 111. In some embodiments, the ring-shaped structure 12 is connected to the rear tip 1119 of each blade 111. In some embodiments, the leading edges 1111 of the blades 111 are all connected to the extension portion 100.

The following description takes two adjacent blades 111*a* and 111*b* for illustration. The distance from the leading edge 1111*a* (i.e. the end point of the blade 111*a* that is most close to the central portion C) of the blade 111*a* to the center of the central portion C is different from that from the leading edge 1111*b* (i.e. the end point of the blade 111*b* that is most close to the central portion C) of the blade 111*b* to the center of the central portion C. In addition, from the center of the central portion C to each of the leading edges 1111 defines a plurality of distances, and at least 50 percent of the distances are different. Preferably, distances from the leading edges 1111 of all of the blades 111 to the center of the central portion C are different. That is, the distances from the leading edges 1111 of all of the blades 111 to the center of the central portion C are unequal to each other. The blade assembly 11 with these features may be formed through injection molding. The blades 111 of the blade assembly 11 may have different exteriors, thereby effectively dispersing the sound spectrum. Not only the work area of the blades can be retained, but also the same heat radiation property can be provided and the advantages of nice sound quality can be achieved. Meanwhile, the advantages mentioned above can be achieved without changing the manufacturing process and materials. On the other hand, the blades 111 of the present disclosure can be made in a manner of deep drawing, the advantages can also be achieved without changing the manufacturing process and materials.

Another feature of the present disclosure is that the distances from any point on the ring-shaped structure 12 to the center of the central portion are the same.

In order to achieve and enhance the advantages described above, lengths of the blades 111 of the blade 1 of the present disclosure are preferably different from each other, so that the sound spectrum may be dispersed effectively.

In some embodiments, when the height of the fan 1 is in a range of 2.5-4.0 mm, the outer diameter of the blade 111 is in a range of 30-50 mm, the diameter of the hub 10 is in a range of 19.5-23.0 mm, and the thickness of the blade 111 is in a range of 0.3-0.5 mm, the amount of the blades 111 is preferably greater than or equal to 30 and less than or equal to 90. When the height of the fan 1 is in a range of 2.5-4.0 mm, the outer diameter of the blade 111 is in a range of 30-55 mm, the diameter of the hub 10 is in a range of 19.5-23.0 mm, and the thickness of the blade 111 is in a range of 0.15-0.35 mm, the amount of the blades 111 is preferably greater than or equal to 35 and less than or equal to 120.

In some embodiments, from the center of the central portion C to each of the leading edges 1111 defines a plurality of distances, and at least 80 percent of the distances are different, and distances from the leading edges 1111 of any two adjacent blades 111 to the center of the central portion C are different. In other words, even though distances from at most 20 percent of the plurality of distances defined above are possible to be equal, however, the distances from the leading edges 1111 of three adjacent blades 111 to the center of the central portion C are different. Therefore, the sound spectrum may be dispersed effectively, and the multi-frequencies noise may be avoided.

In some embodiments, each blade 111 has a protrusion portion 1112, and the protrusion portion 1112 is protruded outside the ring-shaped structure 12. In some embodiments, protruded lengths of the protrusion portions 1112, which are protruded outside the ring-shaped structure 12, of the blades 111 are equal.

In this embodiment, the space between the two adjacent blades 111 are substantially equal. In other words, two adjacent angles A formed by three lines from any three adjacent rear tips 1119 of the rear tips 1119 to the center of the central portion C are the same. Also, in this embodiment, the curvatures of all the blades 111 are different. Certainly, in some embodiments, the space between any two adjacent blades 111 may be unequal, and the curvatures of all the blades 111 may be the same. Furthermore, the curvatures of a part of the blades 111 are equal, and the curvatures of another part of the blades 111 are unequal.

Furthermore, because at least two of the blades 111 are connected to the extension portion 100, the connected part of each of the blades 111 connected to the extension portion 100 defines a front end 1116, and the lengths of the front ends 1116 are different. In other words, each of the front ends 1116 is a part of each of the blades 111 close to the central portion C.

Figure 3A:
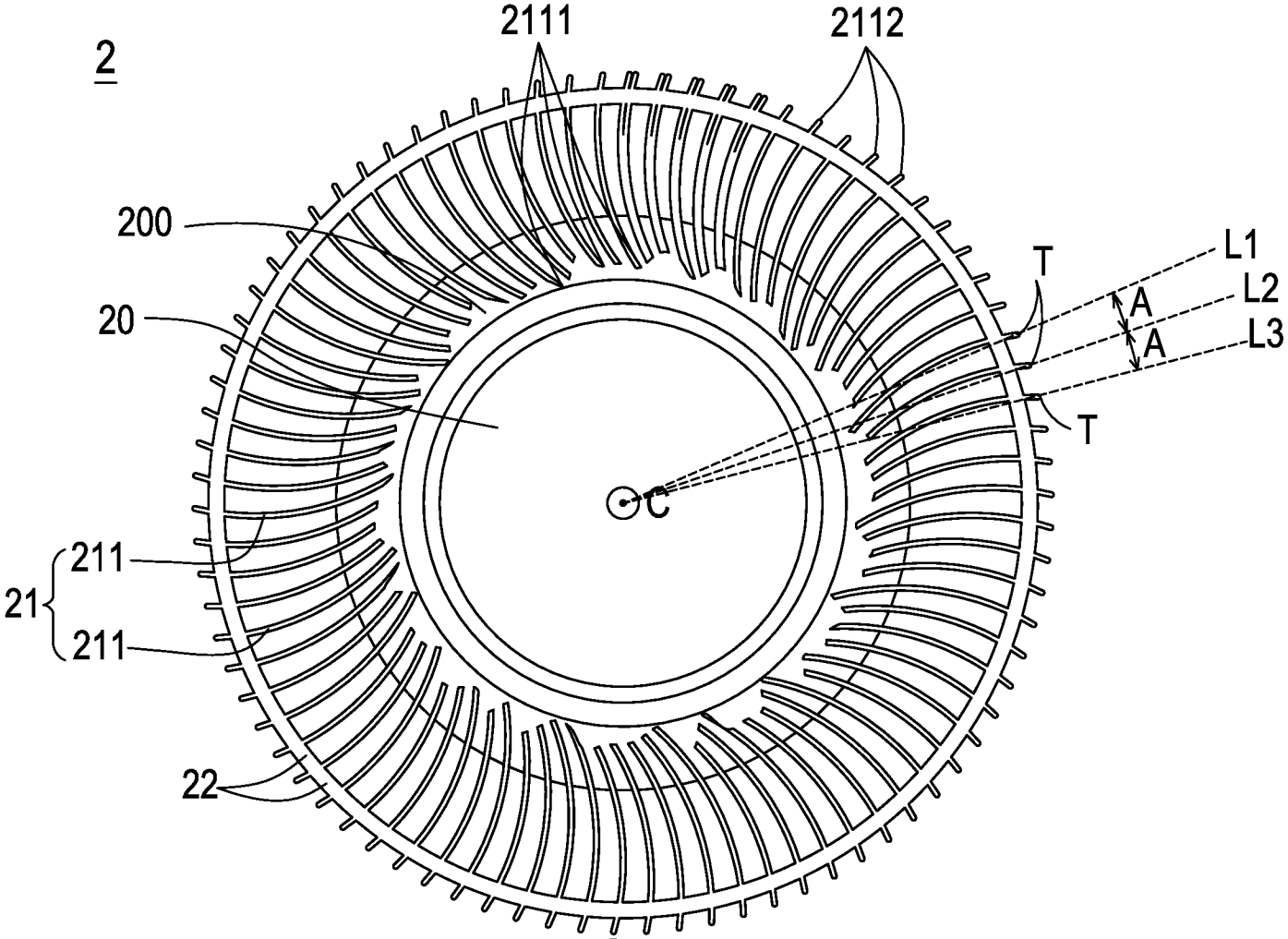
FIG. 3A schematically illustrates the front view of a fan according to another embodiment of the present disclosure.
Figure 3B:
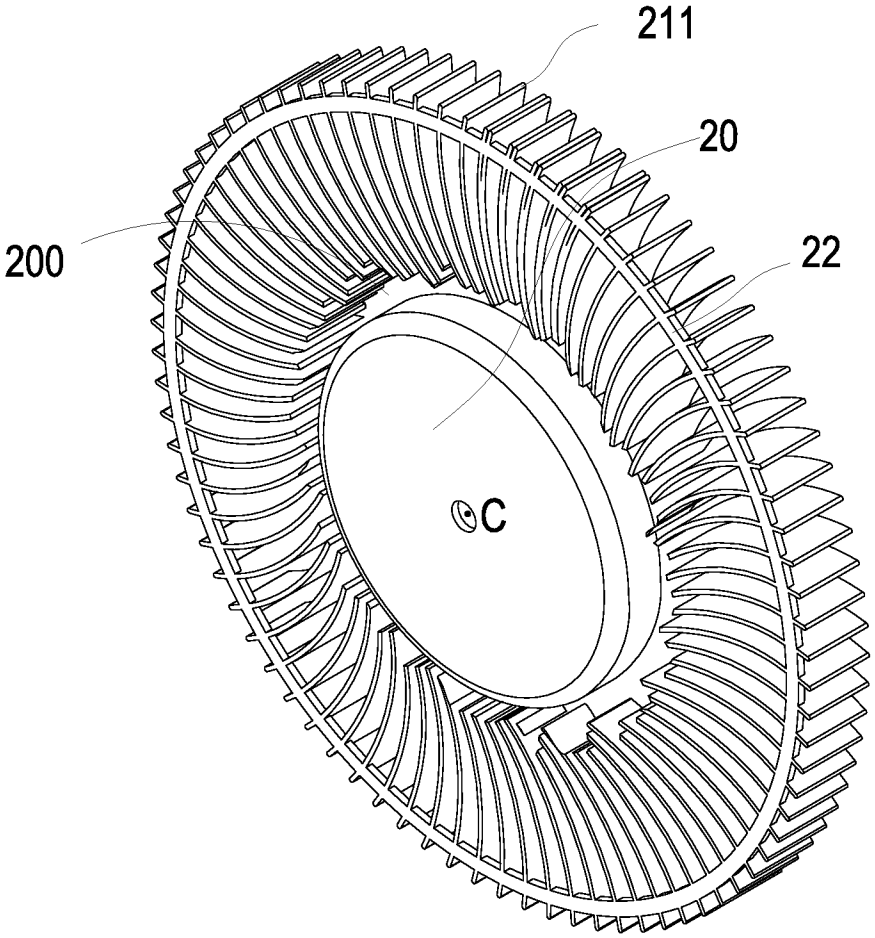
FIG. 3B schematically illustrates the structural view of the fan shown in FIG. 3A.

Please refer to FIGS. 3A and 3B. FIG. 3A schematically illustrates the front view of a fan according to another embodiment of the present disclosure. FIG. 3B schematically illustrates the structural view of the fan shown in FIG. 3A. As shown in FIGS. 3A and 3B, a fan 2 according to another embodiment of the present disclosure includes a hub 20, a blade assembly 21 and a ring-shaped structure 22. The hub 20 has a central portion C and an extension portion 200. The extension portion 200 is extended outwardly from a peripheral edge of the central portion C. The blade assembly 21 includes a plurality of blades 211. From the center of the central portion C to each of the leading edges 2111 defines a plurality of distances, and at least 80 percent of the distances are different. The ring-shaped structure 22 is disposed around the hub 20 with center at the center of the central portion C, and the ring-shaped structure 22 is connected to the blades 211. It should be noted that the structure of the fan 2 in this embodiment is similar with the fan 1 of the above-mentioned embodiment except for the that each blade 211 of the blade assembly 21 of the fan 2 has only one curvature but each blade 111 of the blade assembly 11 of the fan 1 has a straight line portion and a curve portion or has two curve portions with two different curvatures. Other features of the fan 2 are similar with the fan 1, so it is not redundantly described herein.

In this embodiment, the space between two adjacent blades 211 are substantially equal so that two adjacent angles A formed by three lines from any three adjacent rear tips of the rear tips T to the center of the central portion C are the same. Moreover, in this embodiment, the curvatures of the blades 211 are all different. Certainly, in some embodiments, the space between any two adjacent blades 211 may be unequal, and the curvatures of the blades 211 are all the same. Furthermore, the curvatures of a part of the blades 211 are equal, and the curvatures of another part of the blades 211 are unequal.

In some embodiments, each blade 211 has a curvature, and the curvatures of at least a part of the blades 211 are different. In other words, in order to optimize the efficiency of dispersing the sound spectrum or the energy, the differences among different embodiments mentioned above may be superimposed, thereby more effectively dispersing the sound spectrum and avoiding the multi-frequencies noise.

Figure 4A:
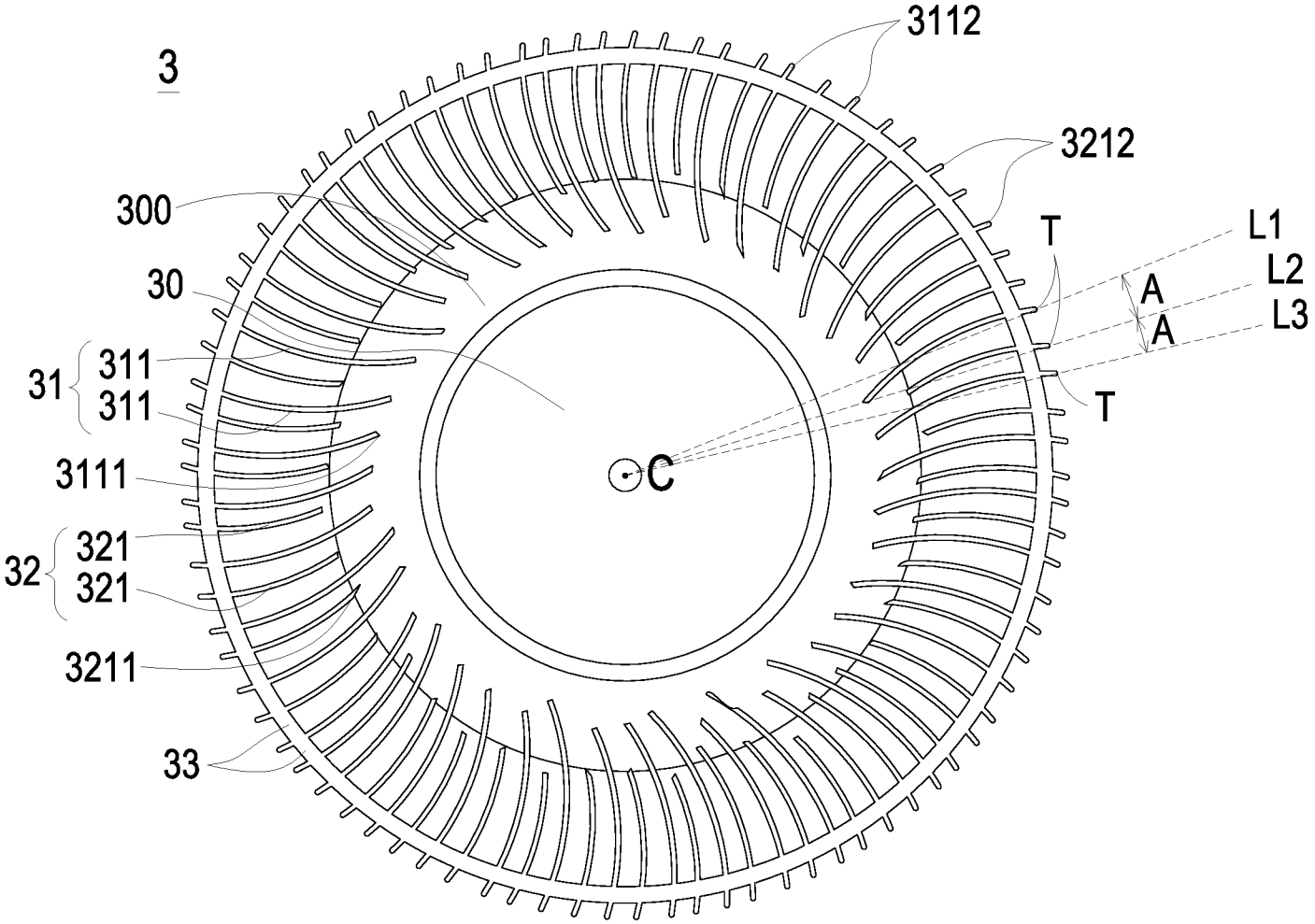
FIG. 4A schematically illustrates the structural view of a fan according to an embodiment of the present disclosure.
Figure 4B:
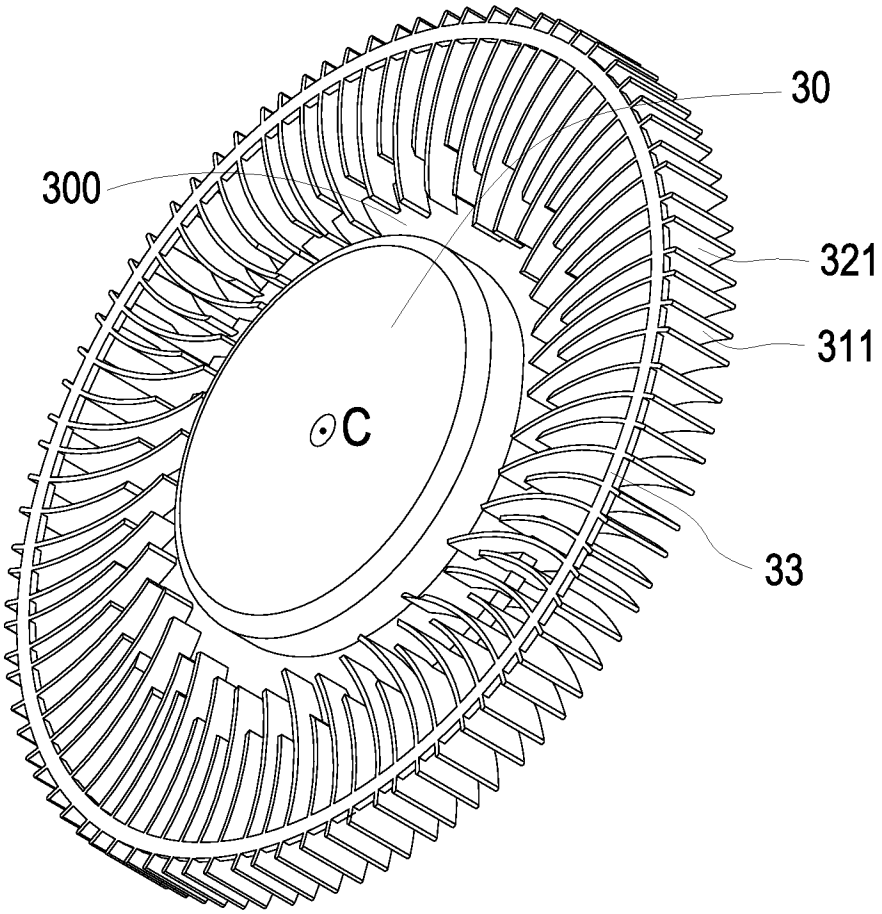
FIG. 4B schematically illustrates the structural view of the fan shown in FIG. 4A.

Please refer to FIGS. 4A and 4B. FIG. 4A schematically illustrates the structural view of a fan according to an embodiment of the present disclosure. FIG. 4B schematically illustrates the structural view of the fan shown in FIG. 4A. As shown in FIGS. 4A and 4B, a fan 3 includes a hub 30, a first blade assembly 31 and a second blade assembly 32. The hub 30 has a central portion C and an extension portion 300. The extension portion 300 is extended outwardly from a peripheral edge of the central portion C. The first blade assembly 31 includes a plurality of first blades 311. The first blade 311 has a first leading edge 3111. Each of the first leading edges 3111 is an end point of each first blade 311 close to the central portion C. The first blades 311 are disposed around the hub 30. At least a part of the first leading edges 3111 of the first blades 311 are connected to the extension portion 300. Distances from the center of the central portion C to the first leading edges 3111 of at least two first blades 311 are different. The second blade assembly 32 includes a plurality of second blades 321. Each second blade 321 has a second leading edge 3211. Each of the second leading edges 3211 is an end point of each second blade 321 close to the central portion C. The second blades 321 are disposed around the hub 30. At least a part of the second leading edges 3211 of the second blades 321 are connected to the extension portion 300. Distances from a center of the central portion C to the second leading edges 3211 of at least two second blades 321 are different.

In some embodiments, the fan 3 of the present disclosure further includes a ring-shaped structure 33. The ring-shaped structure 33 is disposed around the hub 30 with center at the center of the central portion C. The ring-shaped structure 33 is connected to the first blades 311 and the second blades 321.

In order to effectively disperse the sound spectrum and the fan energy and reduce the multi-frequencies noise, the first blades 311 of the first blade assembly 31 may have different lengths, and the second blades 321 of the second blade assembly 32 may have different lengths. The length of the shortest first blade 311 is greater than the length of the longest second blade 321, but not limited herein.

In some embodiments, for achieving similar advantages, the fan 3 of the present disclosure may be implemented as following. The length of the second blade 321 in which the distance from the second leading edge 3211 to the center of the central portion C is the shortest in the second blades 321 is less than the length of the first blade 311 in which the distance from the first leading edge 3111 to the center of the central portion C is the longest in the first blades 311. Furthermore, the shortest one in the distances from the second leading edges 3211 to the center of the central portion C is greater than the longest one in the distances from the first leading edges 3111 to the center of the central portion C.

In some embodiments, each first blade 311 is disposed between two of the second blades 321, and each second blade 321 is disposed between two of the first blades 311 (i.e. the first blades 311 and the second blades 321 are arranged alternatively in series). The multi-frequencies noise is avoided and the advantages of dispersing the sound spectrum is effectively achieved. Furthermore, from the center of the central portion C to each of the first leading edges 3111 defines a plurality of first distances, and at least 50 percent of the first distances are different, and from the center of the central portion C to each of the second leading edges 3211 defines a plurality of second distances, and at least 50 percent of the second distances are different. Preferably, 100 percent of the first distances are different, and 100 percent of the second distances are different.

In this embodiment, the space between any two adjacent blades of the first blades 311 and the second blades 321 are unequal, and each of the first blades and the second blades has a rear tip T, each of the rear tips T is an end point of each of the first blades 311 and the second blades 321 that is far away from the central portion C, two adjacent angles A formed by three lines from any three adjacent rear tips of the rear tips T to the center of the central portion C are different. In this embodiment, each first blade 311 has a curvature, each second blade 321 has a curvature, and the curvatures of each first blade 311 and each second blade 321 are different.

In this embodiment, the first blades 311 are longer than the second blades 321, so the blades are alternatively arranged as a "one long and one short" configuration. In some embodiments, the blades may be alternatively arranged as a "one long and two short" configuration, a "one long and three short" configuration, a "two long and one short" configuration, a "three long and one short configuration, a "two long and two short" configuration or a "two long and three short" configuration.

In some embodiments, each first blade 311 has a first protrusion portion 3112, the first protrusion portion 3112 is protruded outside the ring-shaped structure 33, and protruded lengths of the first protrusion portions 3112, which are protruded outside the ring-shaped structure 33, of the first blades 311 are equal. Each second blade 321 has a second protrusion portion 3212, the second protrusion portion 3212 is protruded outside the ring-shaped structure 33, and protruded lengths of the second protrusion portions 3212, which are protruded outside the ring-shaped structure 33, of the second blades 321 are equal. Each of the protruded lengths of the first protrusion portions 3112 of the first blades 311 is equal to each of the protruded lengths of the second protrusion portions 3212 of the second blades 321. Therefore, the structure is stabilized, and the mechanical strength is enhanced.

Figure 5:
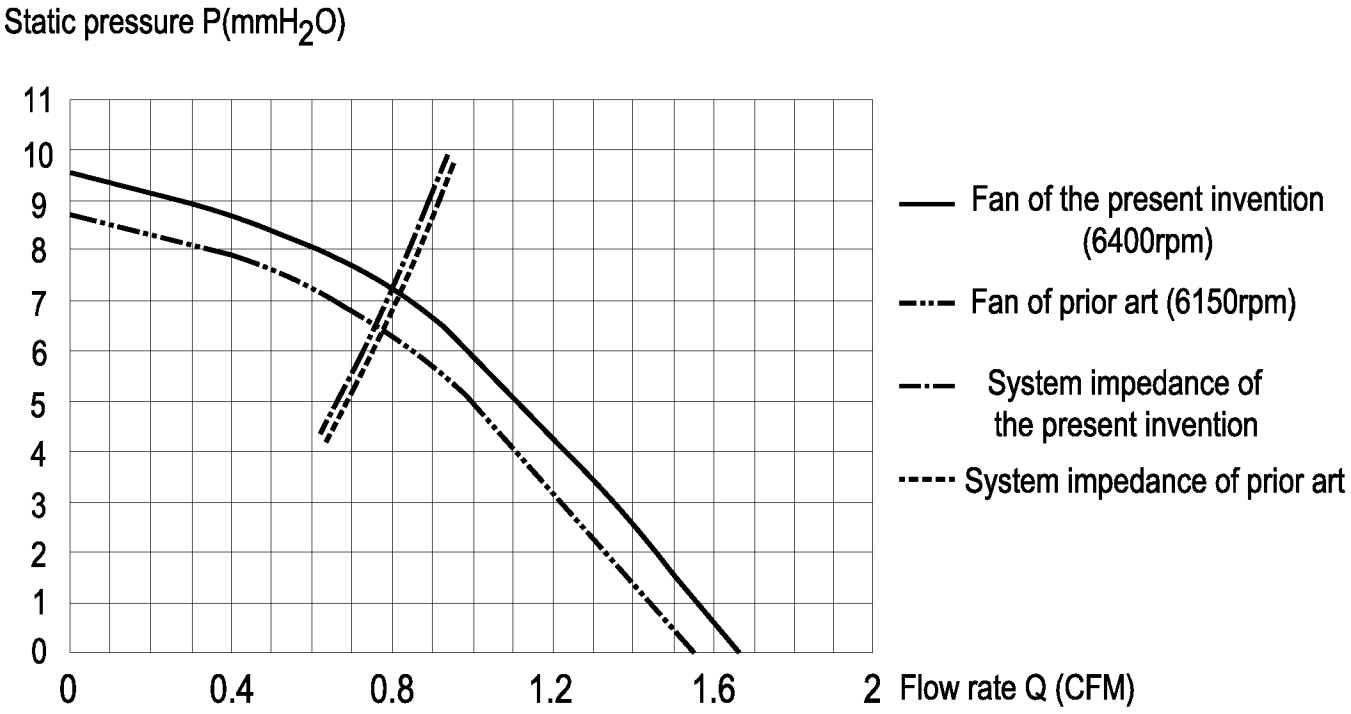
FIG. 5 schematically illustrates the static pressure-capacity diagram of a fan of the present disclosure and a fan of the prior art.

Please refer to FIG. 5. FIG. 5 schematically illustrates the static pressure-capacity diagram of a fan of the present disclosure and a fan of the prior art. As shown in FIG. 5, with the system impedance of the present disclosure, the flow rate Q and the static pressure P of the airflow of the fan of the present disclosure are about 0.8 cubic feet per minute (CFM) and 7.2 $mmH_2O$. With the system impedance of the present disclosure, the flow rate Q and the static pressure P of the airflow of the conventional fan are approximately 0.75 CFM and 6.5 $mmH_2O$. With the system impedance of prior art, the flow rate Q and the static pressure P of the airflow of the fan of the present disclosure are about 0.82 CFM and 7.1 $mmH_2O$. With the system impedance of prior art, the flow rate Q and the static pressure P of the airflow of the conventional fan are approximately 0.77 CFM and 6.4 $mmH_2O$. In brief, the fan design of the present disclosure can disperse the original fan blade frequency, and under the condition of the same system impedance, a better heat dissipation effect can be obtained.

Figure 6A:
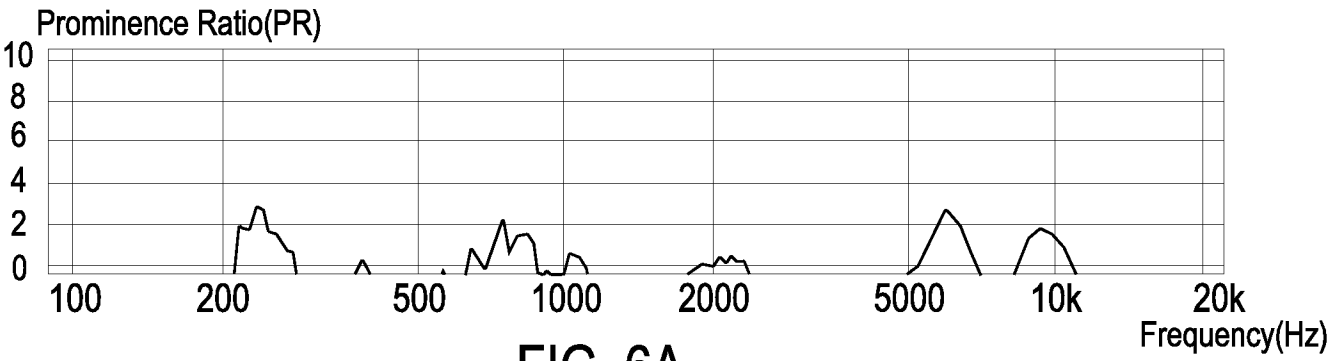
FIGS. 6A, 6B and 6C schematically illustrate the prominence ratio-frequency, the volume-frequency and the volume-order diagrams of the fan of the present disclosure.
Figure 6B:
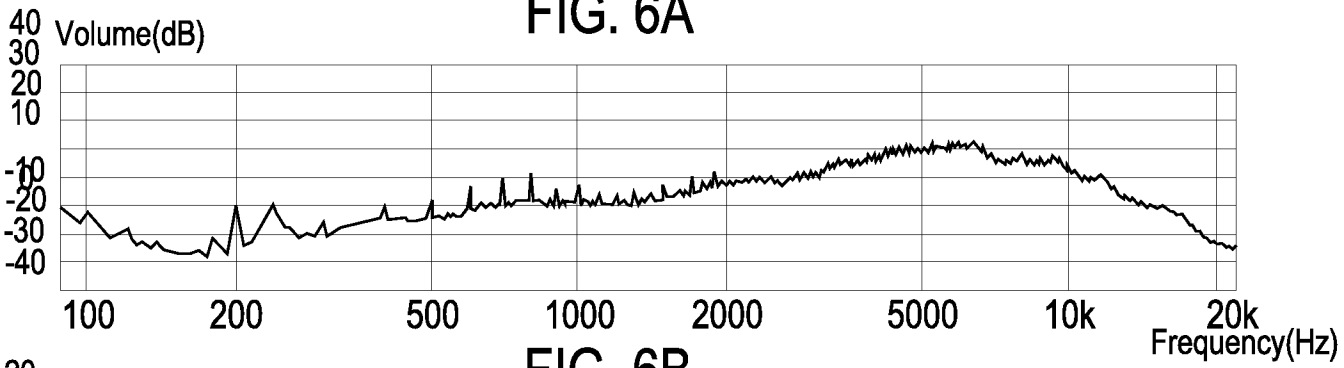
Figure 6C:
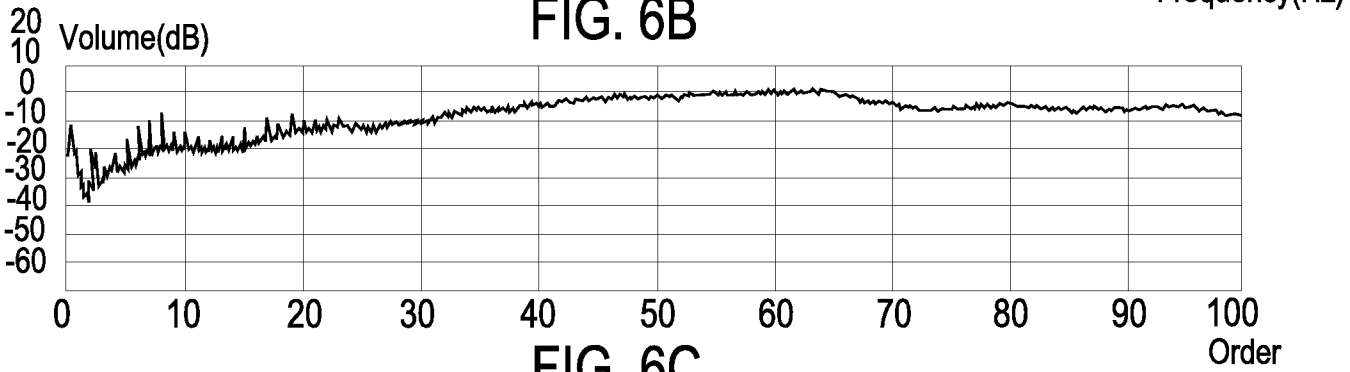

Please refer to FIGS. 6A, 6B and 6C. FIGS. 6A, 6B and 6C schematically illustrate the prominence ratio-frequency, the volume-frequency and the volume-order diagrams of the fan of the present disclosure. As shown in FIGS. 6A, 6B and 6C, in the volume-frequency diagram, it can be seen that there is no obvious peak, which means that no sensible noise is existed. In addition, in the volume-order diagram of the fan of the present disclosure, it is even more apparent that there is no sensible noise because it divides the frequency by 60 to exclude the rotational factors. Finally, from the prominence ratio-frequency diagram of the fan of the present disclosure, it can be seen that the maximum of the prominence ratio values of the fan in the present disclosure are all less than 4, which is almost no feeling of sound. Since the peak value of the prominence ratio value of the conventional fan is about 10, and the acceptable value of the prominence ratio value of human ear is about 7 or less, it can be seen that the fan of the present disclosure is outstanding with the performance of sound quality.

From the above description, the present disclosure provides a fan, by the features that the distances from the leading edges of the blades to the center of the central portion are different, the energies of the blades can be dispersed as an irregular spectrum, thereby avoiding the multi-frequencies noise during operation. Furthermore, the lengths of the adjacent blades are designed to be different, the sound spectrum can further be dispersed. Not only the work area of the blades can be retained, but also the same heat radiation property can be provided and the advantages of nice sound quality can be achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan, comprising:

a hub having a central portion and an extension portion, wherein the extension portion is extended outwardly from a peripheral edge of the central portion; and a blade assembly comprising a plurality of blades, wherein each of the blades has a leading edge, each of the leading edges is an end point of each of the blades that is most close to the central portion, the blades are disposed around the hub, the leading edges of the blades are all directly contacted with the extension portion, from a center of the central portion to each of the leading edges defines a plurality of distances, at least four of the distances are all different, and in at least 50 percent of the distances, each of the distances is different from the rest of the distances.

2. The fan according to claim 1 further comprising a ring-shaped structure, wherein the ring-shaped structure is disposed around the hub with center at the center of the central portion, each of the blades has a rear tip, each of the rear tips is an end point of each of the blades that is far away from the central portion, and the ring-shaped structure is connected to the rear tip of each of the blades or the adjacency of the rear tip of each of the blades.

3. The fan according to claim 2, wherein when the ring-shaped structure is connected to the adjacency of the rear tip of each of the blades, each of the blades has a protrusion portion, and the protrusion portion is protruded outside the ring-shaped structure, and lengths of the protrusion portions are equal.

4. The fan according to claim 1, wherein at least 60 percent, 70 percent or 80 percent of the distances are different from each other.

5. The fan according to claim 1, wherein the distances are all different from each other.

6. The fan according to claim 1, wherein the distances from the center of the central portion to each of the leading edges of any two adjacent blades of the blades are different.

7. The fan according to claim 1, wherein each of the blades has a curvature, and the curvatures of at least a part of the blades are different.

8. The fan according to claim 1, wherein each of the blades has a curvature, and the curvatures of at least a part of the blades are equal.

9. The fan according to claim 1, wherein the space between any two of the adjacent blades are substantially equal, and each of the blades has a rear tip, each of the rear tips is an end point of each of the blades that is far away from the central portion, two adjacent angles formed by three lines from any three adjacent rear tips of the rear tips to the center of the central portion are the same.

10. The fan according to claim 1, wherein the space between any two of the adjacent blades are unequal.

11. The fan according to claim 1, wherein lengths of the blades are different.

12. The fan according to claim 1, wherein the amount of the blades is greater than or equal to 30 and less than or equal to 120.

13. A fan, comprising:

a hub having a central portion and an extension portion, wherein the extension portion is extended outwardly from a peripheral edge of the central portion;

a first blade assembly comprising a plurality of first blades, wherein each of the first blades has a first leading edge, each of the first leading edges is an end point of each of the first blades that is most close to the central portion, the first blades are disposed around the hub, the first leading edges of the first blades are all directly contacted with the extension portion, from a center of the central portion to each of the first leading edges defines a plurality of first distances, at least four of the first distances are all different, and in at least 50 percent of the first distances, each of the first distances is different from the rest of the first distances; and a second blade assembly comprising a plurality of second blades, wherein each of the second blades has a second leading edge, each of the second leading edges is an end point of each of the second blades that is most close to the central portion, the second blades are disposed around the hub, at least a part of the second leading edges of the second blades are in contact with the extension portion, from the center of the central portion to each of the second leading edges defines a plurality of second distances, at least four of the second distances are all different, and in at least 50 percent of the second distances, each of the second distances is different from the rest of the second distances, wherein a length of the shortest one of the first blades is greater than a length of the longest one of the second blades.

14. The fan according to claim 13, wherein each of the first blades is disposed between two of the second blades, and each of the second blades is disposed between two of the first blades.

15. The fan according to claim 13, wherein the first distances are all different from each other, and the second distances are all different from each other.

16. The fan according to claim 13, wherein the length of the second blade in which the distance from the second leading edge to the center of the central portion is the shortest in the second blades is less than the length of the first blade in which the distance from the first leading edge to the center of the central portion is the longest in the first blades.

17. The fan according to claim 16, wherein the shortest one in the distances from the second leading edges to the center of the central portion is greater than the longest one in the distances from the first leading edges to the center of the central portion.

18. The fan according to claim 13 further comprising a ring-shaped structure, wherein the ring-shaped structure is disposed around the hub with center at the center of the central portion, and the first blades and the second blades are connected to the ring-shaped structure, and wherein each of the first blades has a first protrusion portion, the first protrusion portion is protruded outside the ring-shaped structure, and protruded lengths of the first protrusion portions, which are protruded outside the ring-shaped structure, of the first blades are equal.

19. The fan according to claim 18, wherein each of the second blades has a second protrusion portion, the second protrusion portion is protruded outside the ring-shaped structure, and protruded lengths of the second protrusion portions, which are protruded outside the ring-shaped structure, of the second blades are equal.

20. The fan according to claim 19, wherein each of the protruded lengths of the first protrusion portions of the first blades is equal to each of the protruded lengths of the second protrusion portions of the second blades.

21. The fan according to claim 13, wherein each of the first blades has a curvature, each of the second blades has a curvature, and the curvatures of the first blades and the second blades are different.

22. The fan according to claim 13, wherein the space between any two adjacent blades of the first blades and the second blades are unequal, and each of the first blades and the second blades has a rear tip, each of the rear tips is an end point of each of the first blades and the second blades that is far away from the central portion, two adjacent angles formed by three lines from any three adjacent rear tips of the rear tips to the center of the central portion are different.

23. The fan according to claim 13, wherein at least 60 percent, 70 percent or 80 percent of the first distances are different from each other, and at least 60 percent, 70 percent or 80 percent of the second distances are different from each other.

24. A fan, comprising:

a hub having a central portion and an extension portion, wherein the extension portion is extended outwardly from a peripheral edge of the central portion; and a blade assembly comprising a plurality of blades, wherein the blades are disposed around the hub, the blades are all directly contacted with the extension portion, and contacted part of each of the blades in contact with the extension portion defines a front end, lengths of at least four of the front ends are all different, and in at least 50 percent of the lengths of the front ends, each of the lengths is different from rest of the lengths.

* * * * *